US006892965B2

(12) United States Patent
Haeberer et al.

(10) Patent No.: US 6,892,965 B2
(45) Date of Patent: May 17, 2005

(54) FUEL INJECTION VALVE FOR INTERNAL COMBUSTION ENGINES

(75) Inventors: Rainer Haeberer, Bretton (DE); Markus Ohnmacht, Stuttgart (DE); Wilhelm Christ, Ludwigsburg (DE); Ralf Maier, Schwabisch-Gmund (DE); Stefan Haug, Waldenbuch (DE); Wolfgang Fleiner, Stuttgart (DE); Markus Rueckle, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 203 days.

(21) Appl. No.: 10/069,568

(22) PCT Filed: Jun. 27, 2001

(86) PCT No.: PCT/DE01/02371

§ 371 (c)(1),
(2), (4) Date: Jul. 3, 2002

(87) PCT Pub. No.: WO02/01066

PCT Pub. Date: Jan. 3, 2002

(65) Prior Publication Data

US 2002/0179743 A1 Dec. 5, 2002

(30) Foreign Application Priority Data

Jun. 27, 2000 (DE) ..... 100 31 264

(51) Int. Cl.[7] ..... F02M 61/00
(52) U.S. Cl. ..... 239/533.12; 239/533.3
(58) Field of Search ..... 239/533.3, 533.9, 239/533.12

(56) References Cited

U.S. PATENT DOCUMENTS 5,033,679 A * 7/1991 Golev et al. ..... 239/533.3
5,890,660 A * 4/1999 Stevens ..... 239/533.3
6,427,932 B1 * 8/2002 Danckert et al. ..... 239/533.12
6,546,914 B1 * 4/2003 Fath et al. ..... 123/467
6,565,017 B1 * 5/2003 Fath et al. ..... 239/533.3
6,666,388 B2 * 12/2003 Ricco ..... 239/533.9
6,669,117 B2 * 12/2003 Boecking ..... 239/533.3

FOREIGN PATENT DOCUMENTS

| | | |
|---|---|---|
| WO | WO 96 19661 A | 6/1996 |
| WO | WO 99 30028 A | 6/1999 |
| WO | WO 99 58844 A | 11/1999 |
| WO | WO 00 19088 A | 4/2000 |
| WO | WO 01 18387 A | 5/2001 |

* cited by examiner

*Primary Examiner*—Christopher Kim
(74) *Attorney, Agent, or Firm*—Ronald E. Greigg

(57) ABSTRACT

Disclosed is a fuel injection valve including a valve body and a bore, embodied as a blind bore, whose bottom face is oriented toward the combustion chamber, and a conical valve seat having at least one injection port is disposed, is embodied on the bottom face. In the bore, a pistonlike valve member, which is longitudinally displaceable counter to a closing force, is disposed and has a valve member tip, which in the closing position of the valve member comes to rest on the valve seat. A first conical face and a second conical face, disposed toward the combustion chamber toward the first conical face, are embodied on the valve member tip, and the cone angle of the first conical face is smaller than the cone angle of the valve seat, which in turn is smaller than the cone angle of the second conical face. One annular groove is embodied between the first conical face and the second conical face, and an additional encompassing annular groove is disposed on the second conical face and at least partly coincides with the injection ports in the closing position of the valve member, so as to supply all the injection ports uniformly with fuel even if the valve member is off its axis.

20 Claims, 4 Drawing Sheets

FUEL INJECTION VALVE FOR INTERNAL COMBUSTION ENGINES

CROSS-REFERENCE TO RELATED APPLICATIONS

This application is a 35 U.S.C. 371 application of PCT/DE 01/02371, filed on Jun. 27, 2001.

BACKGROUND OF THE INVENTION

1. Field of the Invention

The invention is based on a fuel injection valve for internal combustion engines, preferably self-igniting internal combustion engines.

2. Description of the Prior Art

One fuel injection valve or the type with which this invention is concerned is known from International Patent Disclosure WO 96/19661. In this known valve, a blind bore in which a valve member is guided is embodied in a valve body. The valve member is surrounded on its portion toward the combustion chamber by a pressure chamber which can be filled with fuel at high pressure. A conical valve seat is embodied on the bottom face of the blind bore, toward the combustion chamber. Moreover, at least one injection port, which connects the bore to the combustion chamber, is embodied on the bottom face.

In the closing position, the valve member with its valve member tip comes into contact with the valve seat and thus closes the injection ports off from the pressure chamber. Two conical faces are disposed on the valve member tip, and at their transition an encompassing annular groove is formed, which defines the effective seat diameter of the valve member and has the effect that the opening pressure of the fuel in the pressure chamber during operation does not change. The result is a constant, replicable injection quantity and thus optimal combustion, as long as the valve member moves in a precisely centered way in the bore.

If the valve member is not precisely axially aligned, the inflow of fuel from the pressure chamber at the conical faces of the valve member tip and past the sealing edge to the injection ports is no longer symmetrical. The injection ports, relative to which the valve member is also off its axis, are covered at the onset of the opening stroke motion by the valve member, so that no fuel or only very little fuel can flow to them. Only in the course of the complete opening stroke motion of the valve member are the initially covered injection ports uncovered, and only then can the fuel also flow through these injection ports. The consequence is a reduction in the total injected fuel quantity and thus a power loss to the engine.

The uneven injection into the combustion chamber also causes an air-fuel mixture that is supersaturated with fuel to form in some regions of the combustion chamber volume, while in other regions there is too little fuel in proportion to the existing air. In the supersaturated regions, incomplete combustion accordingly takes place, with the well-known adverse effects on the concentration of pollutants in the exhaust gas.

SUMMARY OF THE INVENTION

The fuel injection valve of the invention has the advantage over the prior art that in the region of the injection ports, at the second conical face of the valve member tip, a further encompassing annular groove is formed, which at the very outset of the opening stroke motion distributes the fuel, flowing from the pressure chamber to the injection ports, to all the injection ports. If in, the opening stroke motion the valve member is off its axis toward one injection port, then some of the fuel flowing to the other injection ports is diverted into a tangential flow through the additional annular groove and thus flows to that injection port. This assures an adequate inflow of fuel to all the injection ports, and even if the valve member is off its axis, a symmetrical injection through all the injection ports is obtained, and the aforementioned disadvantages of uneven injection are averted.

In an advantageous feature, longitudinal grooves are formed in the conical face between the annular groove and the additional annular groove. Through these longitudinal grooves, the fuel is distributed more uniformly and quickly to all the injection ports even if the valve member is off its axis.

In a further advantageous feature, the longitudinal grooves are embodied in an incline to the jacket lines of the conical face disposed between the annular groove and the additional annular groove. The result in the region of the injection ports is a tangential flow of fuel in the additional annular groove around the valve member, which additionally reinforces a uniform distribution of the fuel to the injection ports.

BRIEF DESCRIPTION OF THE DRAWINGS

Various exemplary embodiments of the fuel injection valve of the invention are described herein below, with reference to the drawings, in which.

DESCRIPTION OF THE PREFERRED EMBODIMENTS

Figure 1:
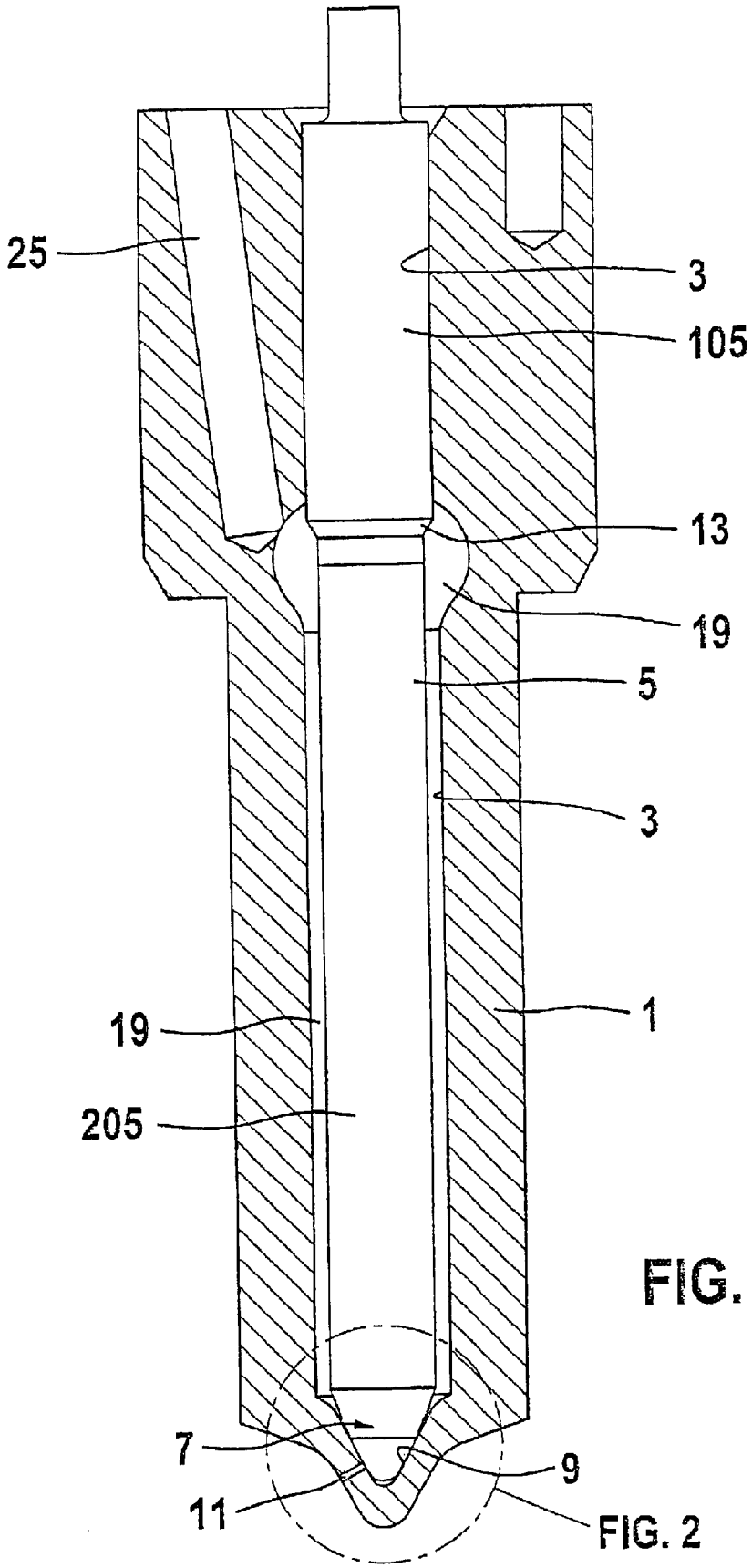
FIG. 1 shows a fuel injection valve partly in longitudinal section.

FIG. 1 shows a longitudinal section through a fuel injection valve. A bore 3, which is embodied as a blind bore and whose closed end is toward the combustion chamber, is disposed in a valve body 1. A conical valve seat 9 and at least one injection port 11, which connects the bore 3 to the combustion chamber, are embodied on the bottom face of the bore 3. A valve member 5 is disposed in the bore 3 and is guided sealingly in the bore in a portion 105 remote from the combustion chamber. The valve member 5 tapers, forming a pressure shoulder 13, toward the combustion chamber and merges with a valve member shaft 205. The end toward the combustion chamber of the valve member 5 forms a valve member tip 7, which adjoins the valve member shaft 205 and tapers further toward the combustion chamber.

The pressure shoulder 13 of the valve member 5 is disposed in a pressure chamber 19, which is embodied in the valve body 1 and surrounds the valve member 5 and which continues, toward the combustion chamber, in the form of an annular conduit surrounding the valve member 5 and extends as far as the valve seat 9. The pressure chamber 19 can be filled with fuel at high pressure via an inflow conduit 25 embodied in the valve body 1.

By means of a closing force, which engages the face end, remote from the combustion chamber, of the valve member 5, the valve member 5 is pressed by the jacket face of the valve member tip 7 against the valve seat 9. The jacket face of the valve member tip 7 upon contact with the valve seat 9 cooperates with the valve seat in such a way that the injection ports 11 are closed off from the pressure chamber 19. In this closing position of the valve member 5, the pressure shoulder 13 and part of the valve member tip 7 are acted upon by the fuel pressure of the pressure chamber 19.

The closing force is generated by a device that is disposed in a valve holding body, not shown in the drawing, which in the installed position of the fuel injection valve is braced against the face end, remote from the combustion chamber, of the valve body 1. This device can for instance be a prestressed spring that acts at least indirectly on the valve member 5. It can also be provided that there are multiple spring in the valve holding body, which generate the closing force individually or in common as a function of the stroke of the valve member 5. Besides being generated by elastic elements such as springs, however, the closing force can also be generated hydraulically, for instance if a control element moved hydraulically acts at least indirectly on the valve member 5 and urges it in the closing position.

The opening stroke motion of the valve member 5 is initiated when the fuel pressure in the pressure chamber 19 rises from a delivery of fuel from the inflow conduit 25. As a result, the hydraulic force on the pressure shoulder 13 and on the fuel-impinged part of the valve member tip 7 rises, bringing about a resultant force on the valve member 5 in the axial direction. If this resultant force exceeds the closing force, then the valve member 5 lifts from the valve seat 9, and fuel can flow out of the pressure chamber 19 past the valve member tip 7 to the injection ports 11 and from there can reach the combustion chamber. When the fuel pressure in the pressure chamber 19 drops again, so that the resultant force becomes less than the closing force, the valve member 5 moves toward the valve seat 9 until it is seated there, closing the injection ports 11 and terminating the fuel injection.

Figure 2:
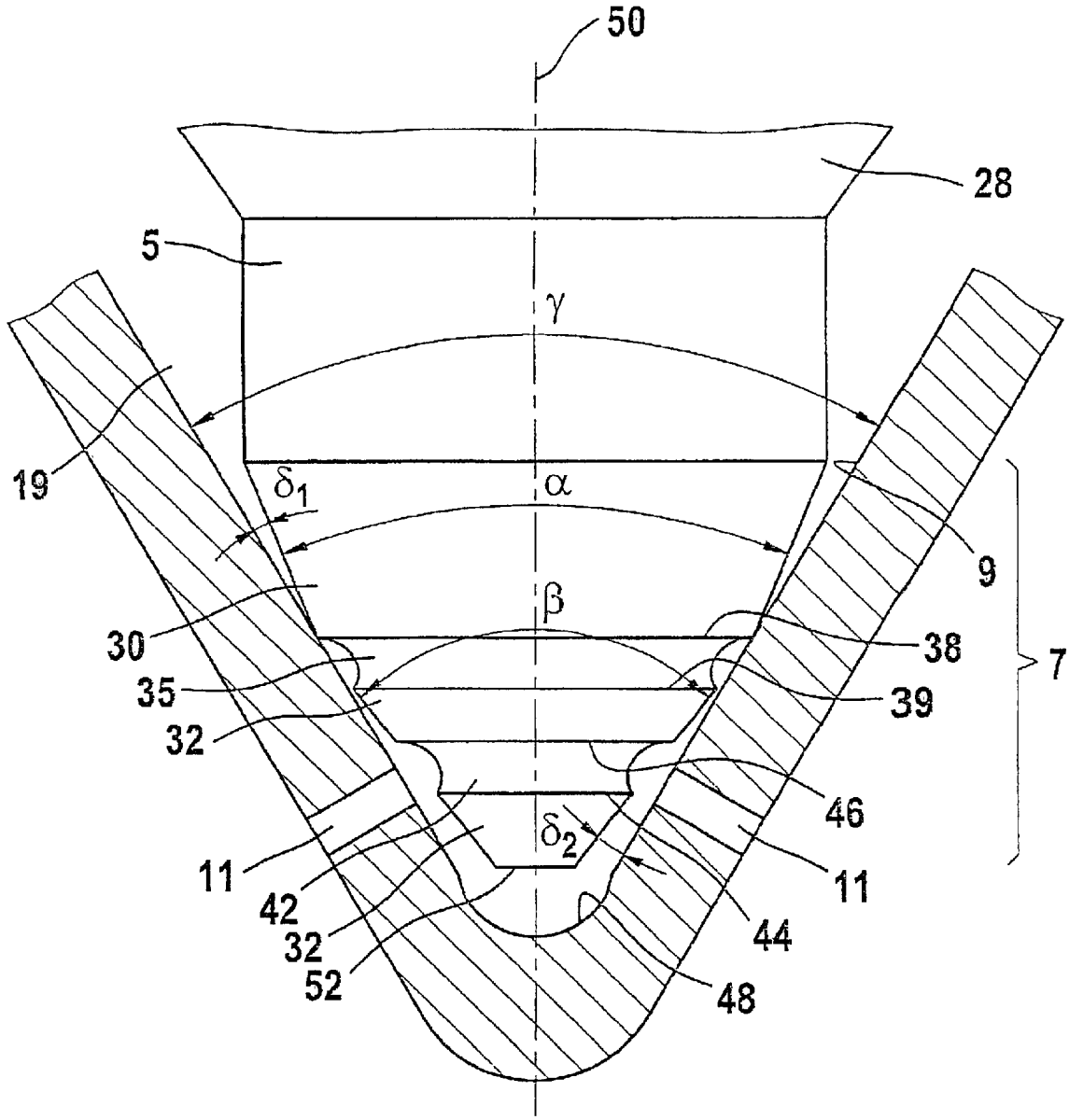
FIG. 2 is an enlarged view of FIG. 1 in the region of the valve seat.

In FIG. 2, the fuel injection valve is shown enlarged in the region of the valve member tip 7 in the closing position of the valve member 5. The valve seat 9 is a conical face with a cone angle $\gamma$, which preferably amounts to from 50 to 70°. At the end toward the combustion chamber, the valve seat 9, for production reasons, changes into a bulge 48. At least one injection port 11 is embodied in the valve seat 9 and extends either perpendicularly or at an incline to the valve sealing face 9. If a plurality of injection ports 11 are provided, then they are preferably distributed uniformly over the circumference of the valve body 1, tailored to the engine combustion chamber to be supplied. The injection ports 11 can for instance be located in a common plane radial to the axis of the valve member 5, or distributed over a plurality of radial planes, or be located in a plane that is inclined to the axis of the valve member 5.

The valve member shaft 205, on its end toward the combustion chamber, merges with the valve member tip 7, forming an intermediate conical face 28. Provision can also be made for the intermediate conical face 28 to be omitted and for the diameter of the valve member shaft 205 to be equivalent to that of the outline of the valve member tip 7. A first conical face 30 is embodied on the valve member tip 7; it adjoins the valve member shaft 205 and has a cone angle $\alpha$ that is less than the cone angle $\gamma$ of the valve seat 9. Toward the combustion chamber, the first conical face 30 is adjoined by a second conical face 32, which has a cone angle $\beta$ that is larger than the cone angle $\gamma$ of the valve seat 9. A differential angle $\delta_1$ is thus formed between the first conical face 30 and the valve seat 9, and a differential angle $\delta_2$ is formed between the second conical face 32 and the valve seat 9. The differential angles $\delta_1$, $\delta_2$ are preferably smaller than 1.5°. On the end toward the combustion chamber, the valve member 5 is flattened, forming an end face 52, which in the closing position of the valve member 5 is disposed inside the bulge 48.

At the transition from the first conical face 30 to the second conical face 32, an encompassing annular groove 35 is disposed, extending in a radial plane to the axis 50 of the valve member 5. The first groove edge 38, which is upstream in terms of the fuel flow to the injection ports, is located on the first conical face 30, while the second, downstream groove edge 39 is located on the second conical face 32. As a result, in the closing position of the valve member 5, the first groove edge 38 comes to rest on the valve seat 9 and seals off the injection ports 11 from the pressure chamber 19.

Because of the closing force on the valve member 5 and the attendant elastic deformation of the first groove edge 38 as well as the preferably small differential angles $\delta_1$, $\delta_2$, the second groove edge 39 additionally comes into contact with the valve seat 9 in the closing position of the valve member 5. This increases the contact surface area, and the pressures per unit of surface area at the valve seat 9 become less.

An additional annular groove 42 is embodied on the second conical face 32. This annular groove is disposed such that it covers the injection ports 11 in the closing position of the valve member 5. The additional annular groove 42 has a cross section that is preferably greater than or equal to the cross section of an injection port 11, so as to enable an unthrottled flow of fuel in the tangential direction in the additional annular groove 42 to the injection ports 11. The cross-sectional shape can be that of a circular arc or can assume any other arbitrary shape, such as a polygonal course or an elliptical curve course.

If the injection ports 11 are disposed in a common radial plane to the axis 50 of the valve member 5, then the additional annular groove 42 is also disposed in such a radial plane. Conversely, if the injection ports 11 are disposed in a plane that is inclined to the radial plane, then the additional annular groove 42 can correspondingly extend in an inclined plane, so as to cover all the injection ports 11 in the closing position.

The mode of operation of the additional annular groove 42 is as follows: If the valve member 5 from the hydraulic force lifts from the valve seat 9, it can happen that the valve member 5 will come off its axis relative to the axis of the bore 3 at the valve seat 9 to an injection port 11. The fuel inflow from the pressure chamber 19 to this injection port 11 is then only limitedly possible, while the remaining injection ports 11, through a flow of fuel past the valve member tip 7, are supplied with fuel. By means of the additional annular groove 42, some of the fuel flow is diverted into a tangential flow by the additional annular groove 42, so that from the onset of the opening stroke motion onward, fuel in an adequate amount flows to the injection port 11 relative to which the valve member 5 is off its axis. In the course of the further opening stroke motion, the valve member 5 with the valve member tip 7 lifts away from the valve seat 9 enough that coming off its axis is no longer a significant factor, and a fuel flow to the injection ports 11 is possible along the jacket lines of the valve member tip 7. Because of this effect of the additional annular groove 42, a uniform injection of fuel is assured, and as a result the fuel injection can proceed replicably and in a manner tuned optimally to the engine operating state.

Figure 3:
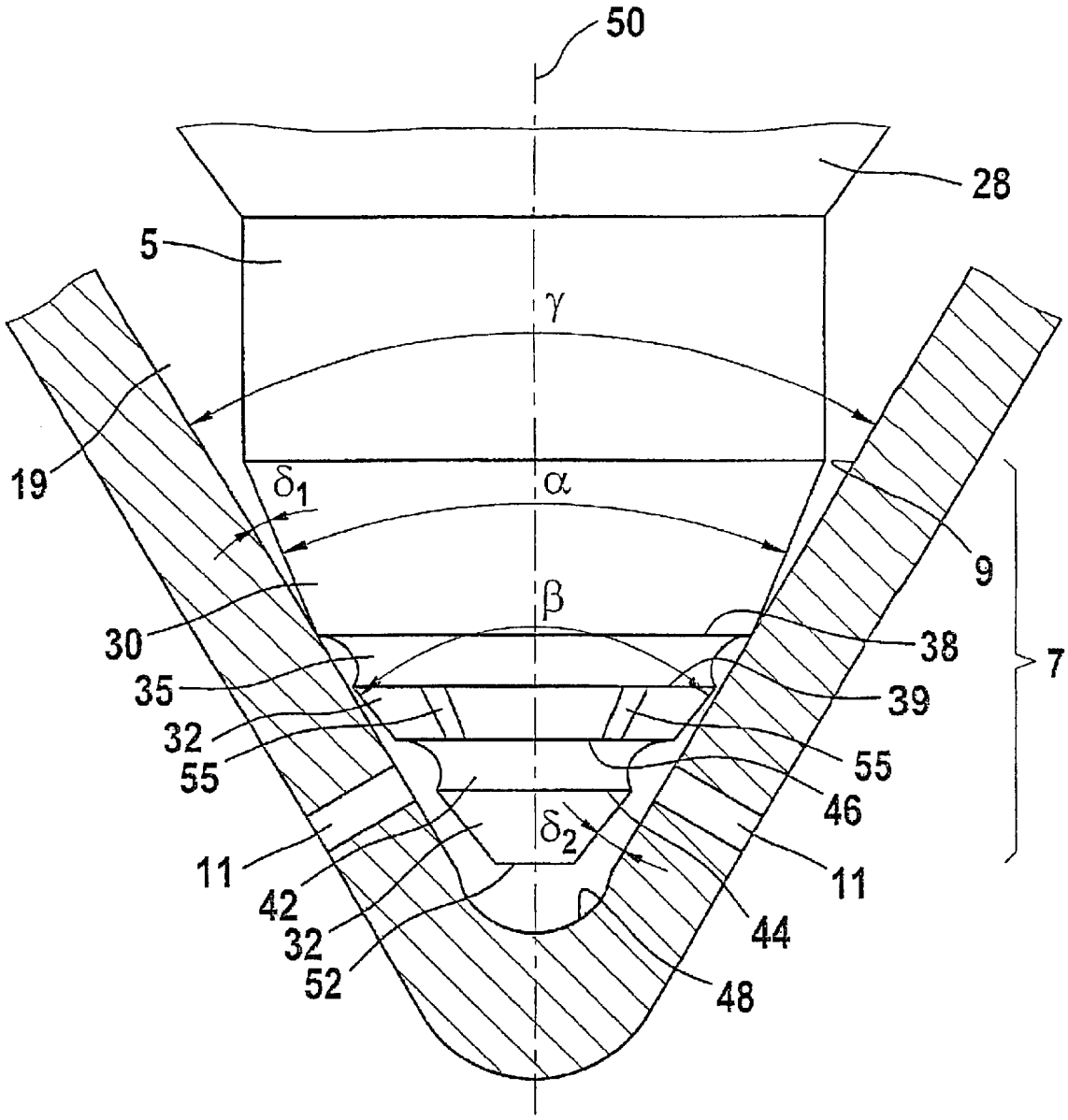
FIGS. 3, 4, 5 and 6 show the same detail as FIG. 2 for further exemplary embodiments.

In FIG. 3, a further exemplary embodiment of the fuel injection valve of the invention is shown. The structure is precisely equivalent to that shown in FIG. 2, except that here, longitudinal grooves 55 that connect the two annular grooves 35, 42 to one another are disposed on the conical face formed between the annular groove 35 and the additional annular groove 42. The longitudinal grooves 55 extend along jacket lines of the conical face formed between the annular grooves 35, 42. By means of these longitudinal grooves 55, a good inflow of fuel into the additional annular groove 42 is provided—especially when the injection valve is only slightly opened at the onset of the opening stroke motion. If it is provided that a plurality of longitudinal grooves 55 be disposed at the valve member tip 7, then they are preferably distributed uniformly over the circumference of the valve member tip 7.

Alternatively, it can also be provided that one or more longitudinal grooves 55 be embodied at an incline to the jacket lines of the conical face formed between the annular grooves 35, 42. This imparts a tangential speed component to the fuel flowing through the longitudinal grooves 55 into the additional annular groove 42, and the fuel is thus quickly distributed to all the injection ports 11.

Figure 4:
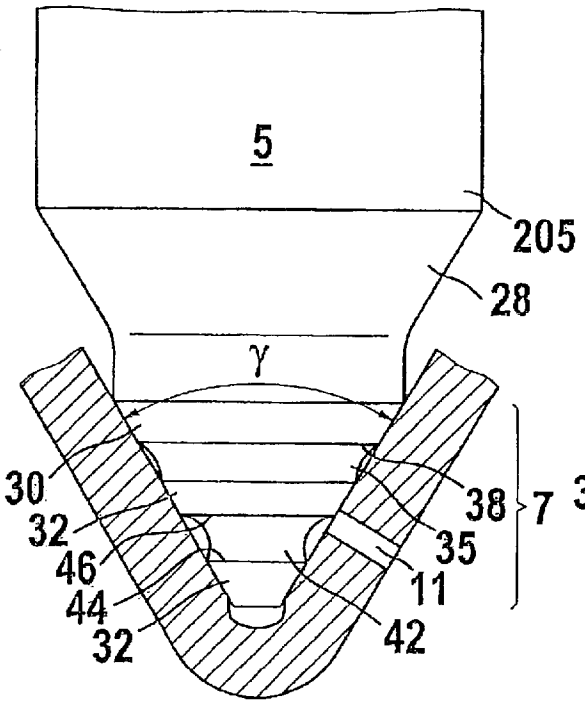

In FIG. 4, a further exemplary embodiment of a fuel injection valve of the invention is shown. The first edge 46 of the additional annular groove 42 is located on the injection ports 11 in the closing position of the valve member 5, so that the conical face located between the annular grooves 35, 42 partly covers the injection ports 11.

Figure 5:
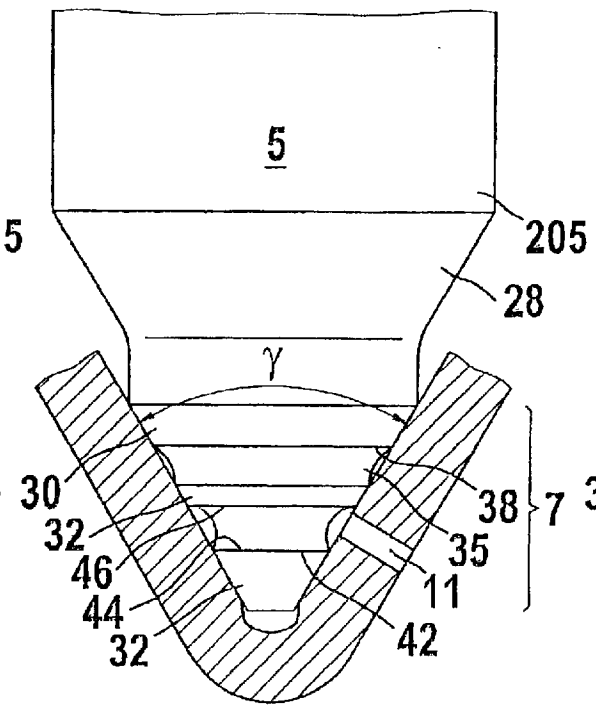

In FIG. 5, the additional annular groove 42 is disposed at the valve member tip 7 in such a way that it completely covers the injection ports 11 in the closing position. The result is a distributing action of the additional annular groove 42 immediately after the valve member tip 7 lifts from the valve seat 9.

Figure 6:
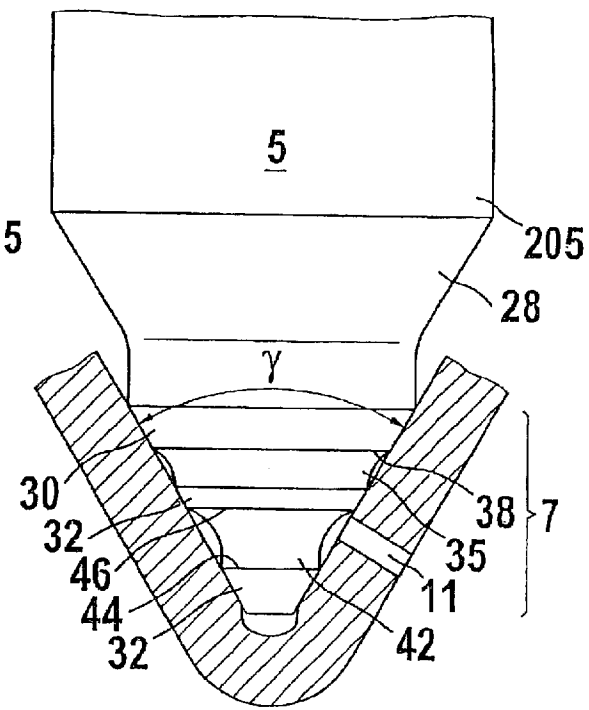

In FIG. 6, a fuel injection valve of the invention is shown in which the additional annular groove 42 is embodied as markedly wider than the diameter of the injection ports 11, and in the closing position of the valve member 5 it completely covers the injection ports 11. This makes it possible to cover a plurality of injection ports 11 that are not all located on the same radial plane relative to the longitudinal axis 50 of the valve member 5 but are still covered by the additional annular groove 42 in the closing position of the valve member 5.

The foregoing relates to preferred exemplary embodiments of the invention, it being understood that other variants and embodiments thereof are possible within the spirit and scope of the invention, the latter being defined by the appended claims.

What is claimed is:

1. In a fuel injection valve for internal combustion engines, having a valve body (1) in which a bore (3) is disposed, on whose end toward the combustion chamber a conical valve seat (9) is embodied in which at least two injection ports (11) are disposed that connect the bore (3) to the combustion chamber, and having a valve member (5), which is guided in the bore (3) and by imposition of pressure by fuel on a pressure face (13) embodied on the valve member (5) is axially movable counter to a closing force aimed at the valve seat (9) and which has a valve member shaft (205), oriented toward the valve seat (9), between which shaft and the wall of the bore (3) a pressure chamber (19) that can be filled with fuel is embodied, which valve member (5), on its end toward the combustion chamber, has a valve member tip (7) on which a first conical face (30) and a second conical face (32) are embodied, the second conical face (32) adjoining the first conical face (30) and being located downstream of the first conical face (30) in terms of fuel flow to the injections ports, and the cone angle ($\alpha$) of the first conical face (30) is less, and the cone angle ($\beta$) of the second conical face (32) is greater, than the cone angle ($\gamma$) of the valve seat (9), and having an annular groove (35), extending all the way around the valve member tip (7), the first groove edge (38) of the annular groove (35) is located in a radial plane to the axis of the valve member (5) and on the first conical face (30), and the second groove edge (39) of the annular groove (35) is located in a radial plane to the axis of the valve member (5) and on the second conical face (32), and the first groove edge (38) of the annular groove (35) is embodied as a sealing edge, which in the closing position of the valve member (5) comes into contact with the valve seat (9) upstream of the fuel flow to the injection ports (11), the improvement comprising an additional annular groove (42) on the second conical face (32) of the valve member tip (7), the additional annular groove (42) at least partly covering the injection ports (11) both in the closing position and in the open position of the valve member (5).

2. The fuel injection valve of claim 1 wherein the cross section of the additional annular groove (42) is greater than or equal to the cross section of an injection port (11).

3. The fuel injection valve of claim 1 wherein that a first differential angle ($\delta_1$), located between the first conical face (30) and the valve seat (9), is smaller than a second differential angle ($\delta_2$), located between the valve seat (9) and the second conical face (32).

4. The fuel injection valve of claim 3 wherein the first differential angle ($\delta_1$) and the second differential angle ($\delta_2$) amount to less than 1.5°.

5. The fuel injection valve of claim 1 wherein the cone angle ($\gamma$) of the valve seat (9) amounts to from 55 to 65°.

6. The fuel injection valve of claim 1 wherein the groove edges (44; 46) of the additional annular groove (42) are located in planes radial to the valve member axis (50) of the valve member (5).

7. The fuel injection valve of claim 1 wherein the conical face adjoining the groove edge (46), remote from the combustion chamber, of the additional annular groove (42) partly covers the injection ports (11) in the closing position of the valve member (5).

8. The fuel injection valve of claim 2 the conical face adjoining the groove edge (46), remote from the combustion chamber, of the additional annular groove (42) partly covers the injection ports (11) in the closing position of the valve member (5).

9. The fuel injection valve of claim 3 wherein the conical face adjoining the groove edge (46), remote from the combustion chamber, of the additional annular groove (42) partly covers the injection ports (11) in the closing position of the valve member (5).

10. The fuel injection valve of claim 4 wherein the conical face adjoining the groove edge (46), remote from the combustion chamber, of the additional annular groove (42) partly covers the injection ports (11) in the closing position of the valve member (5).

11. The fuel injection valve of claim 1 wherein the injection ports (11) are located in a common radial plane relative to the valve member axis (50).

12. The fuel injection valve of claim 1 wherein the groove edges (44; 46) of the additional annular groove (42) and the injection port outlets are in a plane that is inclined to the radial plane of the valve member axis (50).

13. The fuel injection valve of claim 1 further comprising at least one longitudinal groove (55) connecting the two annular grooves on the conical face disposed between the annular groove (35) and the additional annular groove (42), each said at least one longitudinal groove (55) extending along jacket lines of the second conical face (32).

14. The fuel injection valve of claim 2 further comprising at least one longitudinal groove (55) connecting the two annular grooves on the conical face disposed between the annular groove (35) and the additional annular groove (42), each said at least one longitudinal groove (55) extending along jacket lines of the second conical face (32).

15. The fuel injection valve of claim 3 further comprising at least one longitudinal groove (55) connecting the two annular grooves on the conical face disposed between the annular groove (35) and the additional annular groove (42), each said at least one longitudinal groove (55) extending along jacket lines of the second conical face (32).

16. The fuel injection valve of claim 4 further comprising at least one longitudinal groove (55) connecting the two annular grooves on the conical face disposed between the annular groove (35) and the additional annular groove (42), each said at least one longitudinal groove (55) extending along jacket lines of the second conical face (32).

17. The fuel injection valve of claim 5 further comprising at least one longitudinal groove (55) connecting the two annular grooves on the conical face disposed between the annular groove (35) and the additional annular groove (42), each said at least one longitudinal groove (55) extending along jacket lines of the second conical face (32).

18. The fuel injection valve of claim 6 further comprising at least one longitudinal groove (55) connecting the two annular grooves on the conical face disposed between the annular groove (35) and the additional annular groove (42), each said at least one longitudinal groove (55) extending along jacket lines of the second conical face (32).

19. The fuel injection valve of claim 13 wherein a plurality of longitudinal grooves (55) are embodied on the second conical face (32), said longitudinal grooves being distributed uniformly over the circumference.

20. The fuel injection valve of claim 19 wherein at least one of said longitudinal grooves (55) extends at an incline to the jacket lines of the second conical face (32).

* * * * *